US005725217A

United States Patent [19]

White

[11] Patent Number: 5,725,217

[45] Date of Patent: Mar. 10, 1998

[54] PORTABLE DART BOARD STAND

[75] Inventor: Michael S. White, Middletown, Pa.

[73] Assignees: Charles Wilson, Philadelphia, Pa.; Bill A. Kraynik, Sicklerville, N.J.

[21] Appl. No.: 789,938

[22] Filed: Jan. 28, 1997

[51] Int. Cl.[6] ..... F41J 1/10

[52] U.S. Cl. ..... 273/407; 273/403

[58] Field of Search ..... 273/348, 396, 273/395, 400, 401, 402, 403, 404, 407, 406, 408; 473/197, 195, 421, 454, 455, 456, 462, 476, 478, 479, 483

[56] References Cited

U.S. PATENT DOCUMENTS

| | | | |
|---|---|---|---|
| 271,647 | 2/1883 | Medart | 273/403 |
| 2,633,360 | 3/1953 | Fleigle | 273/403 |
| 2,899,204 | 8/1959 | Ratay | 273/407 |
| 3,501,149 | 3/1970 | Meyer | 273/407 |
| 4,029,318 | 6/1977 | Boss | 273/407 |
| 4,629,188 | 12/1986 | Mahieu | 273/407 |
| 5,145,133 | 9/1992 | France | 273/407 |
| 5,209,492 | 5/1993 | Hamilton | 273/407 |

FOREIGN PATENT DOCUMENTS

| | | | |
|---|---|---|---|
| 2079164 | 1/1982 | United Kingdom | 273/407 |

*Primary Examiner*—Mark S. Graham
*Attorney, Agent, or Firm*—Norman E. Lehrer

[57] ABSTRACT

A portable dart board stand comprises a base frame and a support frame. The base frame includes a first transverse member, two opposing primary elongated tubular members which extend from opposite ends of the first transverse member, a second transverse member and two opposing secondary elongated tubular members which extend from opposite ends of the second transverse member. Each of the secondary elongated tubular members has an end which is telescopically mounted to a corresponding one of the primary elongated tubular members. The support frame includes a lower transverse member, two opposing lower elongated tubular members which extend from opposite ends of the lower transverse member, an upper transverse member and two opposing upper elongated tubular members which extend from opposite ends of the upper transverse members. Each of the lower elongated tubular members has an end pivotally secured to a corresponding one of the primary elongated tubular members and each of the upper elongated tubular members has an end telescopically mounted to a corresponding one of the lower elongated tubular members. The support frame is adapted to be moved from an upright configuration, wherein the support frame extends perpendicularly from the base frame, to a collapsed configuration, wherein the support frame extends along the same plane as the base frame.

9 Claims, 2 Drawing Sheets

PORTABLE DART BOARD STAND

BACKGROUND OF THE INVENTION

The present invention relates to a portable dart board stand and, more particularly, to such a stand which includes telescoping members and is equipped with an overhead light. The invention can be more appropriately described as a lightweight stand, which is easily transportable, requires little set-up time and no adjustments in order to hang a dart board and engage in a well illuminated game of darts.

A known type of dart board supporting apparatus fails to address the needs of the end user when the actual utilization of the apparatus is put into use. The known type of dart board supporting apparatus requires extensive set-up/break-down time. This is due to the partial assembly (or disassembly) required each time the unit is put into (or out of) use. Tools are also required.

The known type of dart board supporting apparatus is also difficult to transport. This is due to the overall size and number of parts (including nuts and bolts) which must be separately transported each time the unit is utilized.

The known type of dart board supporting apparatus requires intricate height and distance measurements/adjustments. This is due to the method of hanging the dart board and also the method of adjusting the toeline. The unit is designed to require the user to have a knowledge of proper board height and toeline distance. Adjustment of the apparatus to establish the proper height and distance is extensive and requires tools.

The known type of dart board supporting apparatus fails to supply a means to illuminate the dart board. No provisions are provided to install a light which may be needed to properly illuminate the dart board while play is conducted.

SUMMARY OF THE INVENTION

The present invention seeks to provide a portable dart stand which eliminates the disadvantages of the known type of stand.

According to the invention, a portable dart board stand is provided which is light in weight, is easily transportable, and requires little set-up time and no adjustments in order to hang a dart board and allow a user to engage in a well illuminated game of darts.

Preferably, the stand is easy to assemble and disassemble (with no tools involved) and the entire process can be accomplished quickly. The utilization of telescoping, interlocking, tubular frames which fold up to form a complete unit accomplishes this requirement. The entire steel framework can fold up nicely into a single, easily carried package. The toe board, top frame (which holds dart board) and bracket (for stability) can all be intermingled into one complete package. Three pins can be utilized to engage or disengage in order to allow the complete unit to slide nicely from a folded package to a three dimensional framework; capable of holding a dart board, scoreboard and light with a toe board located at the precise distance from the dart board.

The stand is portable and can be readily transported from one location to another. Accordingly, the number and size of each part is kept to a minimum. There is no need for tools when disassembling or assembling the unit. This would only add to the additional equipment required to be transported. The unit framework can fold up nicely into a single, easily carried package. The use of telescoping, tubular steel framework, with a removable backboard ensures that the unit is light weight, the parts are kept to a minimum and the overall size is kept to a minimum. The unit can be transported easily due to the light weight, compactness of the entire assembly and elimination of tools required for assembly/disassembly.

In the preferred embodiment, the height adjustment from the dart board to the floor and the distance from the dart board to the toeline is accomplished automatically when the unit is assembled. This is accomplished by utilizing spring loaded pins, located within the framework, which catch into pre-drilled holes and automatically set the height of the dart board and the proper distance to the toeline when the unit is unfolded. This is a time saving approach which eliminates the need to measure, adjust or relocate the dart board. There is also no need to obtain knowledge as to the proper measurements required to adjust everything.

It is preferred that provisions be provided to install a light which will properly illuminate the dart board while play is conducted.

The invention provides a lightweight stand, which is easily transportable, requires little set-up time and no adjustments in order to hang a dart board and engage in a well illuminated game of darts.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figures 1, 4:
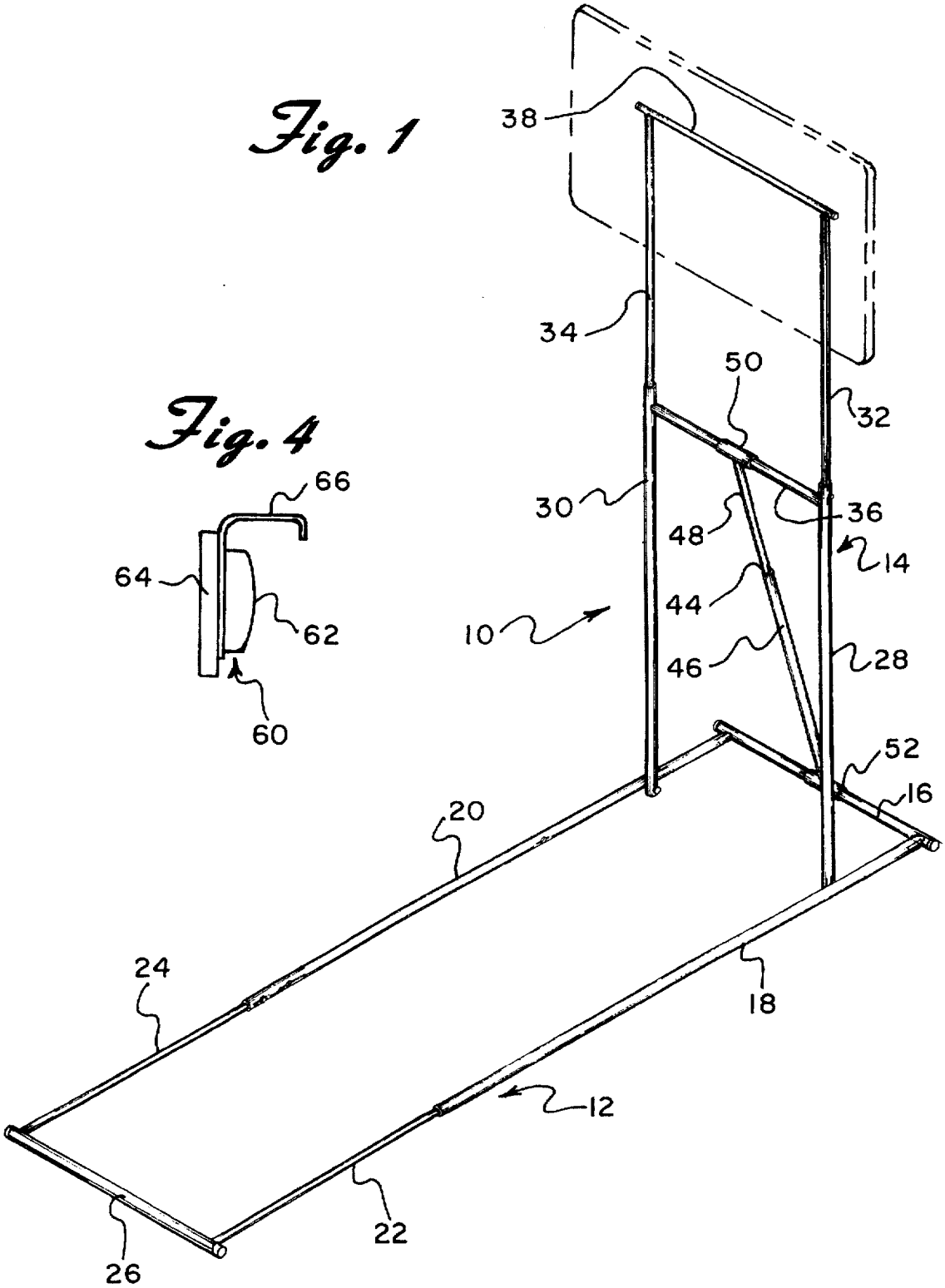
FIG. 1 is a perspective view of the portable dart board stand of the present invention shown in the upright configuration.
FIG. 4 is a side plan view of a light assembly which is adapted to be supported by a dart board.
Figure 3:
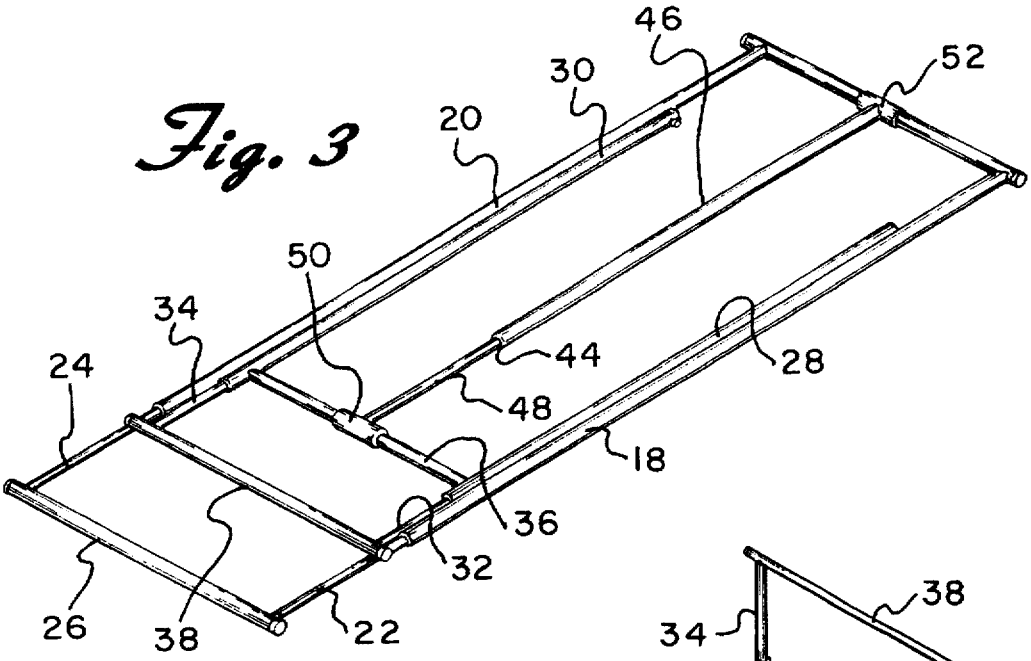
FIG. 3 is a perspective view of the portable dart board stand in the collapsed configuration.
Figure 2:
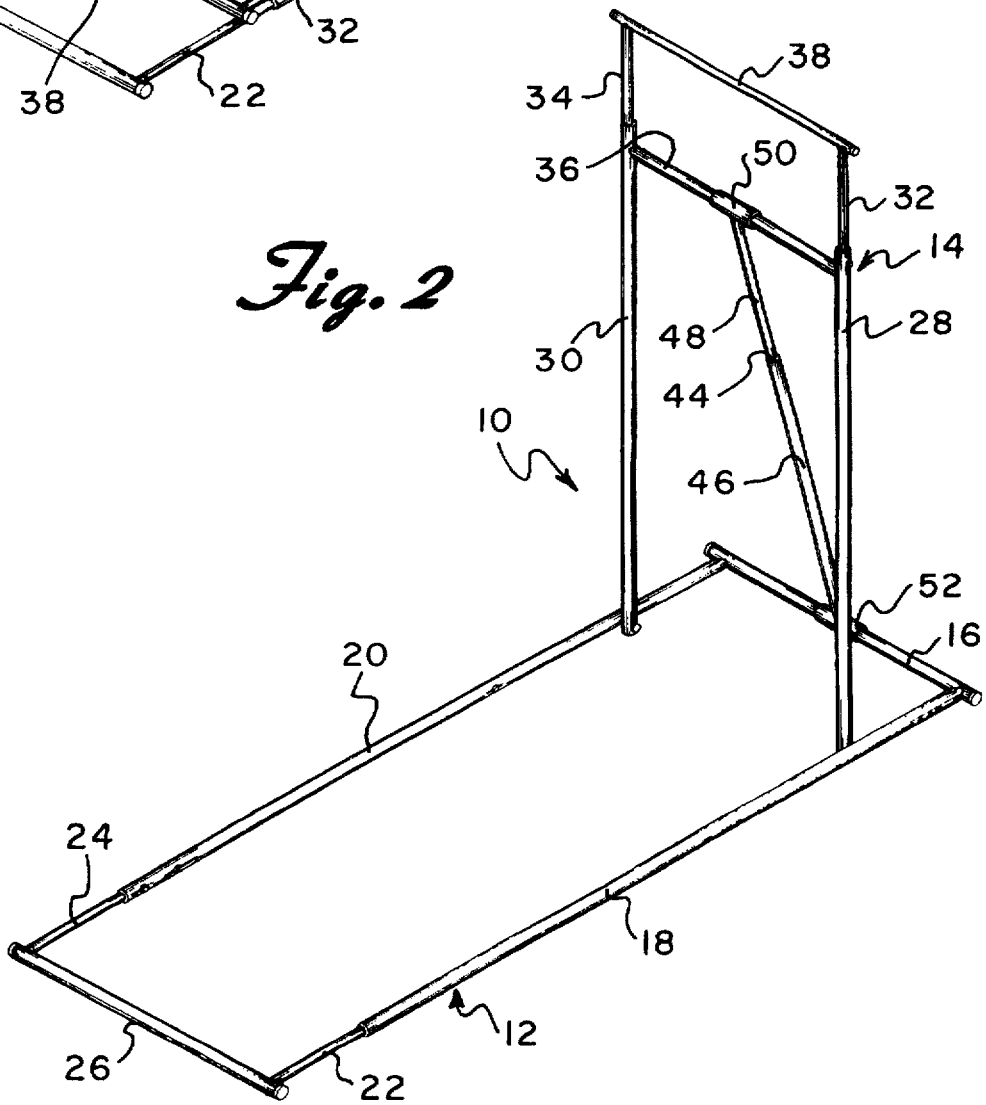
FIG. 2 is a view similar to FIG. 1 showing the upper transverse member positioned closer to the lower transverse member.

Referring now to the drawings in detail wherein like reference numerals have been used throughout the various figures to designate like elements, there is shown in FIGS. 1–3 a portable dart board stand constructed in accordance with the principles of the present invention and designated generally as 10. The portable dart board stand 10 essentially comprises a base frame 12 and a support frame 14.

The base frame 12 includes a first transverse member 16, two primary elongated tubular members 18 and 20 extending outwardly from the transverse member from opposite ends thereof, two secondary elongated tubular members 22 and 24, and a second transverse member 26 extending between the secondary elongated tubular members. Each of the secondary elongated tubular members is telescopically mounted in an end of a corresponding one of the primary elongated tubular members. The secondary elongated tubular members can be pulled from the primary elongated tubular members by grasping the second transverse member 26 and pulling the same outwardly. When the appropriate distance is obtained the elongated tubular members are locked in position by utilizing a spring loaded pin (not shown) which extends through one of the primary elongated tubular members and which is adapted to engage a hole in the secondary elongated tubular member associated therewith. The second transverse member 26 serves as a toeline for a dart player as more fully described below.

The support frame 14 includes two lower elongated tubular members 28 and 30, two upper elongated tubular members 32 and 34, a lower transverse member 36 extending between the two lower elongated tubular members, and an upper transverse member 38. Each of the lower elongated tubular members 28 and 30 has one end pivotally secured to a corresponding one of the primary elongated tubular members 18 and 20. The lower elongated tubular members are each preferably secured to a corresponding primary elongated tubular member by utilizing a bolt, washer and nut in a known manner. This allows the support frame to be moved from an upright configuration to a collapsed configuration as more fully described below.

Each of the upper elongated tubular members 32 and 34 is telescopically mounted in the opposite end of a corresponding lower elongated tubular member 28 and 30. The upper and lower elongated tubular members can be pulled from the lower elongated tubular members by grasping the upper transverse member 38 and pulling the same upwardly. When the appropriate height is obtained, the upper and lower elongated tubular members are locked in position by utilizing a spring loaded pin (not shown) which extends through one of the lower elongated tubular members and which engages a hole in one of the upper elongated tubular members associated therewith.

In the preferred embodiment, a telescoping support bracket 44 is secured between the lower transverse member 36 and the first transverse member 16 in order stabilize and provide rigidity for the support frame 14. More specifically, the support bracket includes a lower segment 46 and an upper segment 48. One end of the upper segment 48 is telescopically mounted in the lower segment 46 of the support bracket 44. An upper T-shaped tubular connector 50 and a lower T-shaped tubular connector 52 are provided and are each rotatably mounted around a corresponding one of the lower and first transverse members 36 and 16, respectively. One end of the upper segment 48 of the support bracket 44 is friction fit in the free end of the tubular connector 50 and one end of the lower segment 46 is friction fit in the free end of the tubular connector 52. When the dart board stand is placed in the upright configuration, a spring loaded pin (not shown), which extends through the lower segment of the support bracket, engages a hole in the upper segment in order to lock the dart board stand in the proper position as more fully described below.

A light assembly 60 is preferably provided (FIG. 4). The light assembly includes a fluorescent light 62, a protective light cover 64, and a mounting attachment 66. The light assembly is preferably mounted to a dart board (shown in phantom in FIG. 1) in order to illuminate the same.

In order to facilitate an understanding of the principles associated with the foregoing apparatus, its operation will now be briefly described. When the portable dart board stand 10 is ready to be used it is moved from the collapsed configuration (FIG. 3) to the upright configuration (FIG. 1). More specifically, the support frame is rotated upwardly so that the upper and lower elongated tubular members extend perpendicularly from the base frame 12 (FIG. 2). As the support frame 14 is so rotated, the upper segment 48 of the support bracket 44 is pulled from the lower segment 46 until the spring loaded pin in the lower segment engages the hole in the upper segment 48. The upper transverse member 38 is then pulled upwardly until the spring loaded pin, which extends through one of the lower elongated tubular members, engages a hole in the upper elongated tubular member associated therewith.

Thereafter, the second transverse member 26, which serves as a toeline, is pulled outwardly until the spring loaded pin, which extends through one of the primary elongated tubular members, engages the hole in the secondary elongated tubular member associated therewith. It should be noted that there could be several holes in the secondary elongated tubular member so various toeline distances could be obtained.

A dart board is then mounted adjacent the upper transverse member 38 in a known manner. Thereafter, the light assembly 60 is mounted to the dart board in order to properly illuminate the same.

When the dart board stand 10 is to be placed in the collapsed configuration so that it can be transported or stored, the dart board is first removed from the stand. Thereafter, the spring loaded pin associated with the upper and lower elongated tubular members is depressed into the hole in the upper elongated tubular member so that the upper transverse member 38 can be moved downwardly. The spring loaded pin associated with the support bracket 44 is then depressed into the hole in the upper segment so that the support frame 14 can be collapsed (FIG. 3). Finally, the pin associated with the primary and secondary elongated tubular members is depressed into the hole in the secondary elongated tubular member so that the second transverse member 26 can be moved inwardly.

The present invention may be embodied in other specific forms without departing from the spirit or essential attributes thereof and accordingly reference should be made to the appended claims rather than to the foregoing specification as indicating the scope of the invention. For example, there could be additional holes in the secondary and upper elongated tubular members as well as in the upper segment of the support bracket in order for the spring loaded pins to engage in order to lock the portable dart board stand into the collapsed configuration.

What is claimed is:

1. A portable dart board stand comprising:

a base frame including a first transverse member, two opposing primary elongated tubular members extending from said first transverse member from opposite ends thereof, a second transverse member, two opposing secondary elongated tubular members extending from said second transverse member from opposite ends thereof, each of said secondary elongated tubular members having an end telescopically mounted to a corresponding one of said primary elongated tubular members;

a support frame including a lower transverse member, two opposing lower elongated tubular members extending from said lower transverse member from opposite ends thereof, an upper transverse member, two opposing upper elongated tubular members extending from said upper transverse member from opposite ends thereof, each of said lower elongated tubular members having an end pivotally secured to a corresponding one of said primary elongated tubular members, each of said upper elongated tubular members having an end telescopically mounted to a corresponding one of said lower elongated tubular members, and said support frame being adapted to be moved from an upright configuration, wherein said support frame extends perpendicularly from said base frame, to a collapsed configuration, wherein said support frame extends along the same plane as said base frame.

2. The portable dart board stand of claim 1 further including means for locking said support frame in said upright configuration.

3. The portable dart board stand of claim 2 wherein said means for locking said support frame in an upright configuration includes:

a support bracket having an upper segment and a lower segment, said upper segment having a hole therein, said upper segment having one end telescopically mounted to an end of said lower segment and having an opposing end secured to said lower transverse member, said lower segment having an end secured to said first transverse member, and a spring loaded pin extending from said lower segment of said support bracket, said spring loaded pin being adapted to engage said hole in said upper segment when said support frame is placed in said upright configuration.

4. The portable dart board stand of claim 1 further including means for locking said second transverse member in a predetermined location.

5. The portable dart board stand of claim 4 wherein said means for locking said second transverse member includes:

a pin means, and said primary and said secondary elongated tubular members each having a hole therein, said pin means being adapted to simultaneously extend into each of said holes in said primary and secondary elongated tubular members.

6. The portable dart board stand of claim 1 further including means for locking said upper transverse member at a predetermined distance from said lower transverse member.

7. The portable dart board stand of claim 6 wherein said means for locking said upper transverse member at a predetermined distance from said lower transverse member includes:

a pin means, and said upper and lower tubular members each having a hole formed therethrough, said pin means being adapted to extend simultaneously extend into each of said holes in said upper and lower elongated tubular members.

8. The portable dart board stand of claim 1 further including dart board securing means for securing at least one dart board to said support frame.

9. The portable dart board stand of claim 8 further including a light assembly and means adapted for securing said light assembly to said dart board.

* * * * *